US006895604B1

(12) United States Patent
Ramsey

(10) Patent No.: US 6,895,604 B1
(45) Date of Patent: May 24, 2005

(54) SELF-CONTAINED EXHAUST FAN FOR A WATER CLOSET

(76) Inventor: Cris A. Ramsey, 4114 Heartstone Dr., Grapevine, TX (US) 76051

( * ) Notice: Subject to any disclaimer, the term of this patent is extended or adjusted under 35 U.S.C. 154(b) by 0 days.

(21) Appl. No.: 10/440,648

(22) Filed: May 19, 2003

(51) Int. Cl.[7] ..... A47K 13/00
(52) U.S. Cl. ..... 4/213; 4/217
(58) Field of Search ..... 4/209 R, 213, 4/216, 217, 347, 348

(56) References Cited

U.S. PATENT DOCUMENTS

| | | | |
|---|---|---|---|
| 2,849,727 | A | 9/1958 | Bollinger et al. |
| 3,659,296 | A | 5/1972 | Stamper |
| 3,689,944 | A | 9/1972 | Clayton |
| 4,344,194 | A | 8/1982 | Pearson |
| 4,586,201 | A | 5/1986 | Todd, Jr. |
| 4,853,981 | A | 8/1989 | Hunnicutt, Jr. |
| 5,539,937 | A | 7/1996 | Barefoot |

FOREIGN PATENT DOCUMENTS

WO WO 90/06404 * 6/1960

OTHER PUBLICATIONS

Mary Beth Breckenridge, "Smart Cleaning Avoids Spread of Germs," The Morning News, Springdale Arlansas, Dec. 11, 2000, p. 5C.

Cecil Adams, "Does flushing the toilet cause dirty water to be spewed around the bathroom?," The Straight Dope, Apr. 16, 1999.

* cited by examiner

*Primary Examiner*—Gregory L. Huson
*Assistant Examiner*—Khoa Huynh
(74) *Attorney, Agent, or Firm*—Mark W. Handley; Chauza & Handley, L.L.P.

(57) ABSTRACT

An exhaust fan unit (26) is mounted in a hole (86) which extends through a central region (27) of a lid (22) of a water closet (12) for exhausting air from within a bowl (16) of the water closet (12) when the lid (22) is horizontally disposed, in a closed position. A housing (32) is mounted to the lid (22) and has a window (56) for receiving a filter cartridge (34). A control circuit (96) has a position sensor (144) and control logic (142). The position sensor (144) detects when the lid (22) is moved from a vertically disposed, open position to the closed position. The control logic (142) applies electric power to operate the fan unit (72) for a predetermined time interval when the lid (22) is disposed in the closed position.

20 Claims, 13 Drawing Sheets

SELF-CONTAINED EXHAUST FAN FOR A WATER CLOSET

TECHNICAL FIELD OF THE INVENTION

This invention relates in general to water closets and exhaust fans for water closets, and in particular to a self-contained exhaust fan for a water closet which operates to reduce the amount of bacteria which occurs in non-ventilated water closets.

BACKGROUND OF THE INVENTION

Scientific studies have determined that bacteria and viral microbes often collect in the bowls of water closets. The swirling of water during the flushing of conventional water closets causes the release of bacterial and viral aerosols into the air around the water closets, contaminating the air within bathrooms. Photographs taken of germy substances collected on gauze pads placed adjacent to the outer peripheries of water closets confirm that significant quantities of microbial and viral aerosols have been ejected from water close bowls and floated around the air of bathrooms for at least two hours after a flush. The microbial and viral aerosols ejected into the air land on various surfaces in the bathroom, including household items such as toothbrushes. It is suspected that ejections of microbial and viral aerosols from water closets have resulted in the spread of diseases and infection. The microbial aerosols range in size from two to ten microns. Research has shown that the concentration of similar sized aerosol particles is significantly reduced when passed through filters of a Merv eleven rating at an eighty percent minimum composite efficiency, based on ASHRAE Standard 52.2.

SUMMARY OF THE INVENTION

An exhaust fan unit filters microbial and viral aerosols from the bowl of a water closet after the water closet is flushed. A two micron filter is located at the intake of the exhaust fan, and is preferably replaced at least once a month. A replaceable dust filter is located at the discharge of the exhaust fan. A control circuit includes a position sensor and control logic. The position sensor detects when the lid is moved from an upwards to a downward position, and then the fan will operate for a predetermined time interval, preferably for two minutes, to filter airborne microbes and viruses form within the toilet bowl. A signal light is provided by an LED which is turned on when the exhaust fan is being powered.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
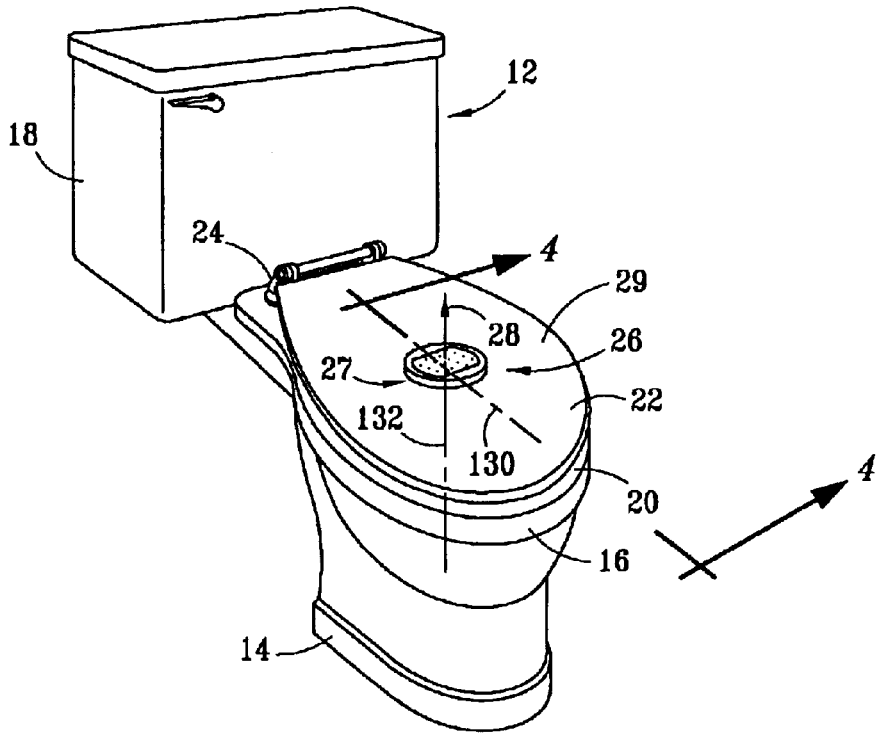
FIG. 1 is a perspective view of a water closet having a self-contained exhaust fan mounted to a lid of the water closet.

FIG. 1 is a perspective view of a water closet 12 having a base 14, a toilet bowl 16, a tank 18, a seat 20 and a lid 22. The seat 20 and the lid 22 are mounted to the toilet bowl 16 by two hinges 24. The seat 20 and the lid 22 are shown in downward, horizontal positions, with the seat 20 and the lid 22 being horizontally disposed, covering the toilet bowl 16. A self-contained exhaust fan unit 26 is mounted to a central region 27 of the lid 22. The exhaust fan unit 26 will remove air from the toilet bowl 16, filter the air and exhaust the air upwards in the direction 28 and above an upperside 29 of the lid 22, perpendicular to a horizontal plane.

Figure 2:
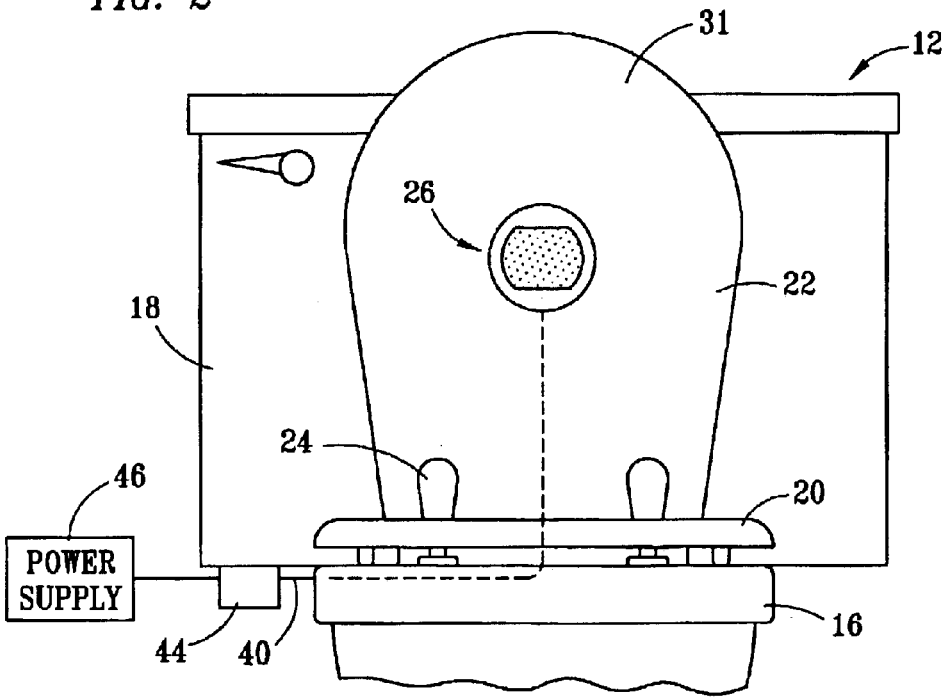
FIG. 2 is a side elevation view showing the lid in an upward position.

FIG. 2 is a side elevation view of the water closet 12, showing the lid 22 in a vertical position, such that the toilet bowl 16 is open. When the lid 22 is in a vertical position, the lid 22 will extend in a vertical direction. A lower end of the exhaust unit 26 is shown mounted to an underside 31 of the lid 22. The upperside 29 and the underside 31 of the lid 22 together define a plane for the lid 22, which extends parallel to the sides 29 and 31. As defined herein, the lid 22 is disposed in the upwards, or open, position when the plane of the lid 22 is vertical, as shown in FIG. 2. The lid is disposed in the downward, or closed, position when the plane of the lid is horizontal, as shown in FIG. 1. The exhaust fan unit 26 is connected to a transformer 44 and a power supply 44 by a wire 40 which extends through the interior of the lid 22, and along the underside of the toilet bowl 16. The power supply 44 is preferably provided by standard building or household electric power which is connected to the exhaust fan 26 by a transformer 44. Preferably the transformer 44 includes a rectifier, and provides an output power of twelve volts D.C.

Figure 3:
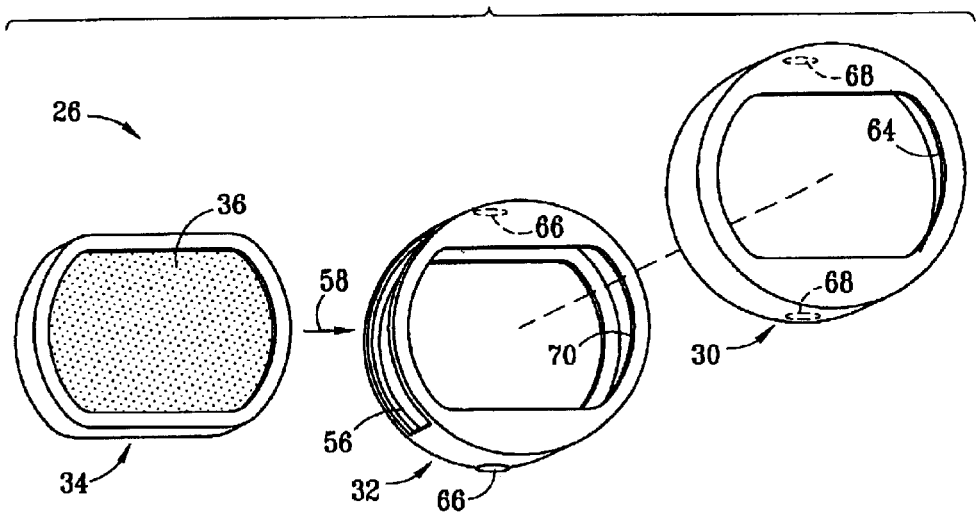
FIG. 3 is an exploded, perspective view of the self-contained exhaust fan.

FIG. 3 is an exploded, perspective view of the exhaust unit 26. The main components of the exhaust unit 26 are a cover 30, a base 32, a filter cartridge 34. The cover 30 is removably secured to the base 32, covering the lower side of the base unit 32. The lower side of the base 32 is that portion which extends beneath the lid 22 when the lid 22 is disposed in a downward position. The filter cartridge 34 includes a filter media 36, which preferably filters particles which range in size from two to ten microns. Preferably, the filter media 36 has a Merv rating of eleven at an eighty percent minimum composite efficiency, based on ASHRAE Standard 52.2. The base 32 has a filter cartridge window 56 through which the filter cartridge 34 is installed and removed from the base 32 for replacing the filter media 36. The filter cartridge 34 is mounted within the base 32 by moving the cartridge 34 in the direction 58 through the window 56 and into the base 32.

The base 32 has latch tabs 66 which are provided by protuberances molded into opposite ends of base 32. Preferably, the latch tabs 66 are on upper and lower ends of the base 32, as defined when the lid 22 is disposed in an upward, or vertical position, as shown in FIG. 2. Clasp tabs 68 are molded into opposite ends of the cover 30 for securing to the latch tabs 66, to releasibly secure the cover 30 to the base 32. The cover 30 has an airflow window 64 and the base 32 has an inlet window 70 which register to provide an intake of the exhaust unit 26 when the cover 30 is mounted to the base 32. Preferably, the airflow inlet 64 of the cover 30 has an aperture which is of a size and shape which is slightly smaller than the size and shape of the filter media 36 of the filter cartridge 34, such that a pattern of discoloration will occur when the filter media 36 is soiled to alert the user that the media 36 is soiled and requires replacement when the filter media 36 in the cartridge 34 is inspected. Preferably, as least part of the window 64 will overlap the window 70, such that the overlap of window 64 is disposed within an adjacent portion of the window 70. This provides the fan inlet window 70 in the base 32 being of a different size than the window 64 of the cover 30, such that the window 70 exposes a different portion of the filter media 36 than the window 64, the filter media 36 may be inspected for discoloration from soiling after removal of the cover 30 and without removal of the filter cartridge 34 from the base 32. Similarly, in other embodiments, the windows 64 and 70 may be of different shapes for exposing different portions of the filter media for soiling when the cover 30 is removed from the base 32.

Figure 4:
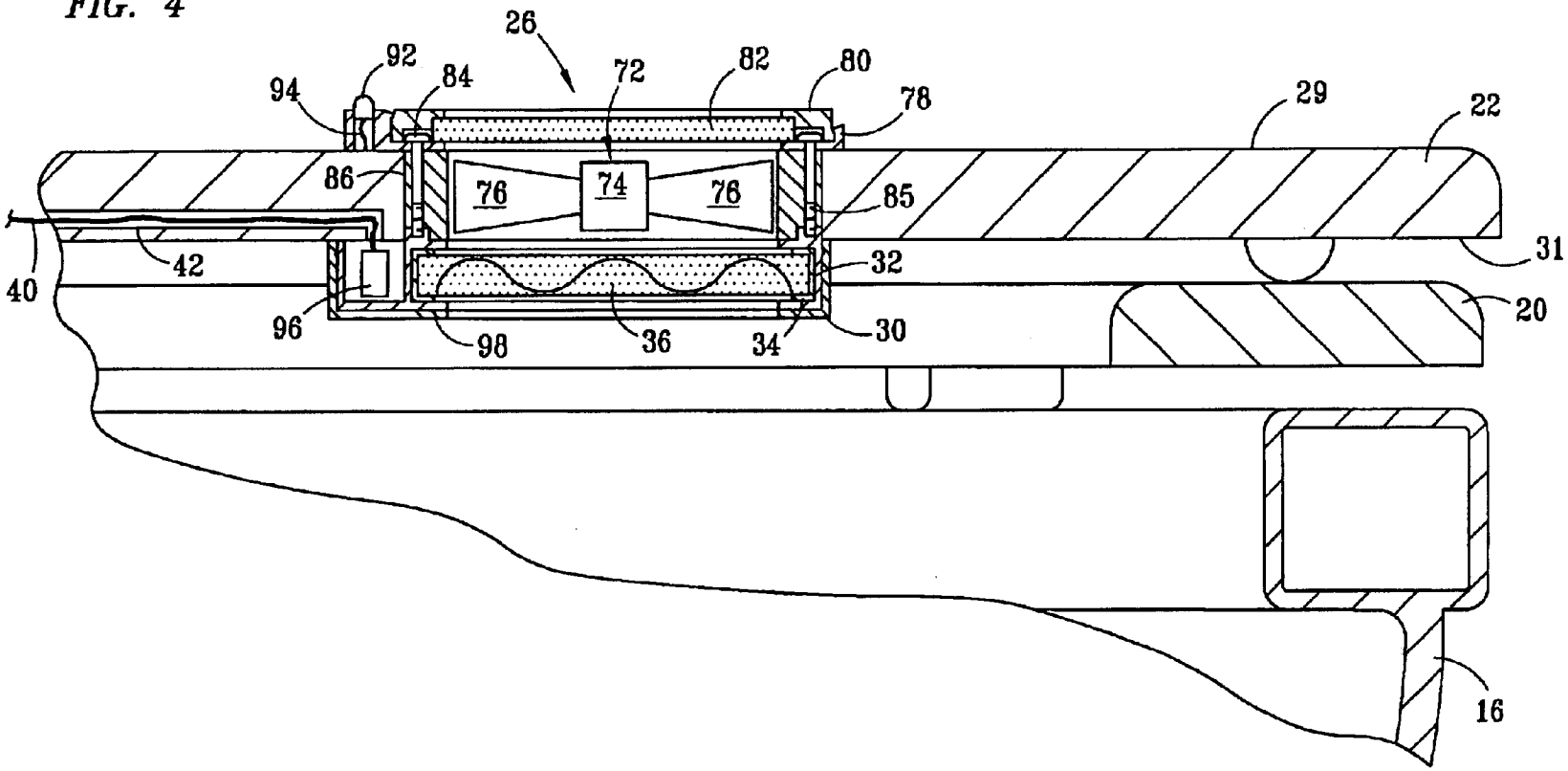
FIG. 4 is a sectional view of the water closet and self-contained exhaust fan, taken along section line 4—4 of FIG. 1.

FIG. 4 is a sectional view of the lid 22 and the exhaust unit 26, taken along section line 4—4 of FIG. 1. The exhaust unit 26 has a fan unit 72 which includes a fan motor 74 and fan blades 76. Preferably, the fan motor 74 is a. 12.0 volt DC powered electric motor. A mounting bracket 78 is provided for mounting to an upperside 29 of the lid 22, with the upperside 29 of the lid 22 being defined when the lid 22 is in a lowered, or downward, horizontal position, shown in FIG. 1. A cap 80 is provided for securing to the mounting bracket 78. A dust cover 82, which is preferably formed of foam, is mounted between the lid cap 80 and the mounting bracket 78. The cap 80 and the dust cover 82 are removable from the mounting bracket 78 so that the dust cover 82 may be cleaned or replaced. Mounting bolts 84 extend through the mounting bracket 78, through a housing 85 of the fan unit 72 and are threadingly secured to the base 32. The filter cartridge 34 is secured within the base 32, with the filter media 36 disposed adjacent to the inlet of the fan 72. The dust cover 82 is disposed adjacent to the outlet of the fan unit 72. Power wires 40 extend through a hole 42 in the lid 22. The power wires 40 connect to a control unit 96. A signal light 92 is provided by an LED which is mounted in a cavity 94 of the mounting bracket 78. The signal light 92 is connected to the control unit 96 by conductors 94, preferably by routing the conductors through a surface groove formed in the peripheral edge of the housing 85 for the fan unit 72.

Figure 5:
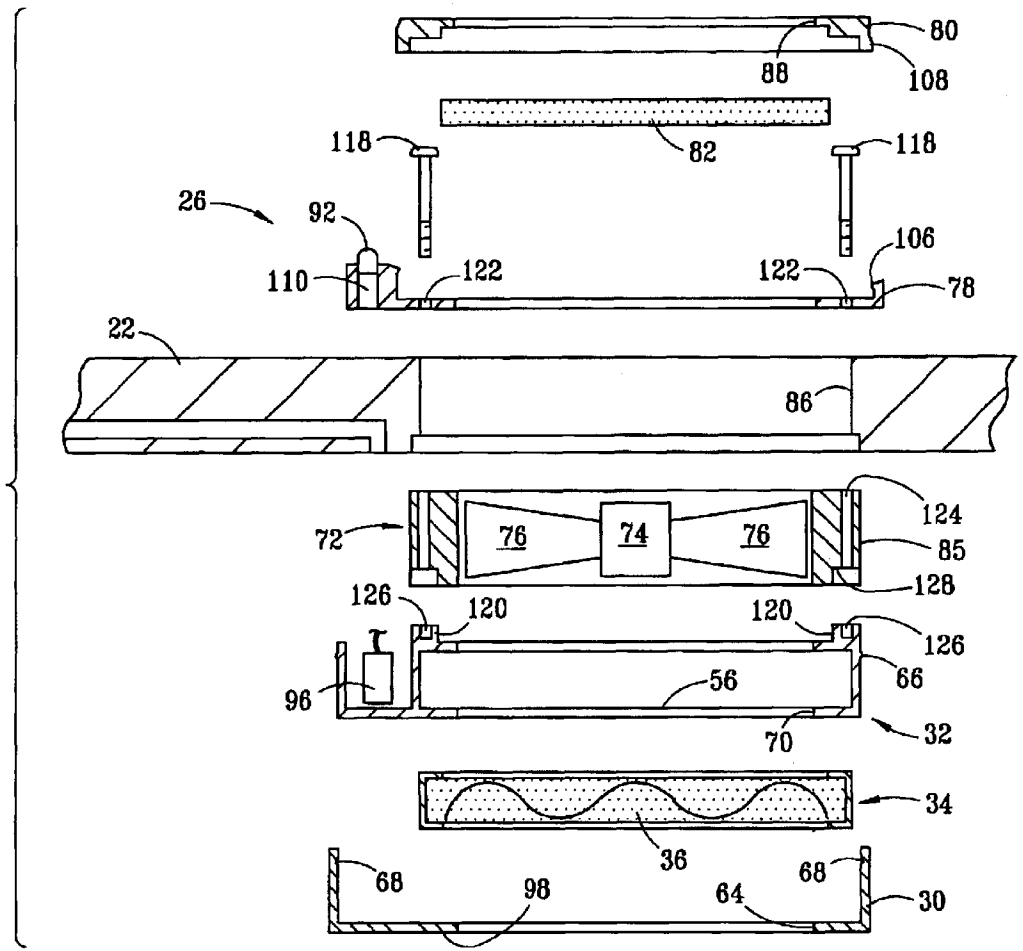
FIG. 5 is a exploded, sectional view of the self-contained exhaust fan.

FIG. 5 is an exploded, sectional view of the various components of the exhaust unit 26. A window 88 is located in a central region of the cap 80. The cap 80 has a protuberance 108 which defines an exteriorly extending lip that extends from an exterior periphery at the lower end of the cap 80. The mounting bracket 78 has an inwardly extending protuberance 106 which defines an interiorly extending lip that the extends from an interior profile of the mounting bracket 78 and an adjacent, interiorly disposed recess for receiving the protuberance 108 of cap 80. The protuberances 106 and 108 interlock to releasibly secure the cap 108 to the mounting bracket 78 in a snap-in type engagement. A hole 86 is formed through the toilet lid 22, and the fan unit 72 is mounted within the hole 86. Preferably, the hole 86 is a round, circular hole, but in other embodiments it may be of another shape, such as square, octagonal, and the like. When the hole 86 is of a different shape than circular, the exterior periphery of the housing 85 of the fan unit 72 may have a periphery of a shape which matches a shape defined by the profile of the hole 86 to lock the fan unit 72 in a fixed angular position relative to the lid 22 of the water closet 12.

Mounting holes 122 are provided in the mounting bracket 78. The fan housing 85 has mounting holes 124. The underside of the fan housing 85 has openings 128 aligned adjacent to the mounting holes 124 for receipt of the bosses 120 formed as part of the upperside of the base 32. The bosses 120 have threaded apertures 126 for threadingly receiving the shanks of the mounting bolts 118. The mounting bolts 118 extend through the mounting holes 122 and the mounting holes 124, and then pass into the threaded apertures 126 of the bosses 120 to secure the mounting bracket 78 and the base 32 on opposite sides of the toilet seat lid 22, with the housing 85 of the fan unit 72 disposed in the mounting hole 86, sandwiched between the base 32 and the mounting bracket 78. The lower end of the cover plate 30 has a lower face 98, which is disposed adjacent to the aperture providing the window 64. The latch catch 66 is provided on the base 32 for being engaged with the latch clasp 68 of the cover 30, to removably secure the cover 30 to the base 32.

Figure 6:
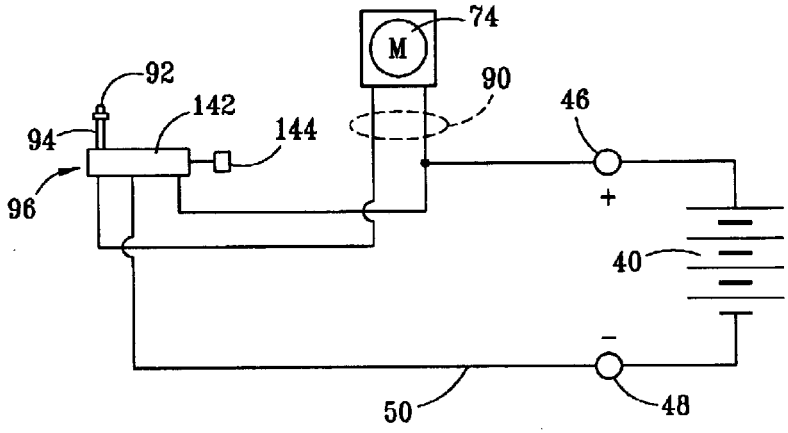
FIG. 6 is a circuit diagram of the control circuitry for the self-contained exhaust fan.

FIG. 6 is a circuit diagram of the electric and control components of the exhaust unit 26. The power wires 40 provides electric power across the contacts 46 and 48, preferably 12 volts DC. Power is applied to the control unit 96, which includes circuitry 142 and a position sensor 144. The position sensor 144 is preferably a ball type, tilt sensor. The position sensor 144 is mounted in the base 32 and to the toilet seat lid 22, such that the electrical connection across the electrical contacts 46 and 48 will be broken depending upon whether the lid 22 is disposed in one of two positions, either a closed, lowered, horizontal position, shown in FIG. 1, or in an open, upwards, vertical position, shown in FIG. 2. In the preferred embodiment, a conductive metal ball in the position sensor 144 will complete a circuit path between two contacts when the lid 22 is in the downward position of FIG. 2, and the circuit path between the two contacts will be broken when the lid 22 is disposed in the upward position shown in FIG. 1. Depending upon the orientation of the position sensor 144, the circuit path may be either made or broken when the lid 22 is disposed in the downward position in alternate embodiments. The circuitry 142 is preferably provided by a programmable component, having both timers and counters, and control circuitry logic programmed into the component. Conductors 90 connect the fan motor 74 to the control unit 96 and to the power contact 46. After the lid 22 is moved to a downward, horizontal position to cover the toilet bowl 16, power is applied to the fan motor 74 to move air from the toilet bowl 16 through the filter media 36. The fan 72 will run for a preselected time interval, and then power will be removed from the fan motor 74. If the lid 22 is opened and closed during the time interval which the motor 74 is operating, the control unit 96 will restart the preselected time interval after the lid 22 is closed. The preselected time interval which the exhaust unit 26 is operated is preferably two minutes. The signal light 92 is connected to the circuitry 142 by the conductors 94, and is preferably provided by an LED. Power will be applied to the signal light 92 only when power is applied to the exhaust fan motor 74 to indicate that the exhaust fan unit 26 is operating.

Figure 7:
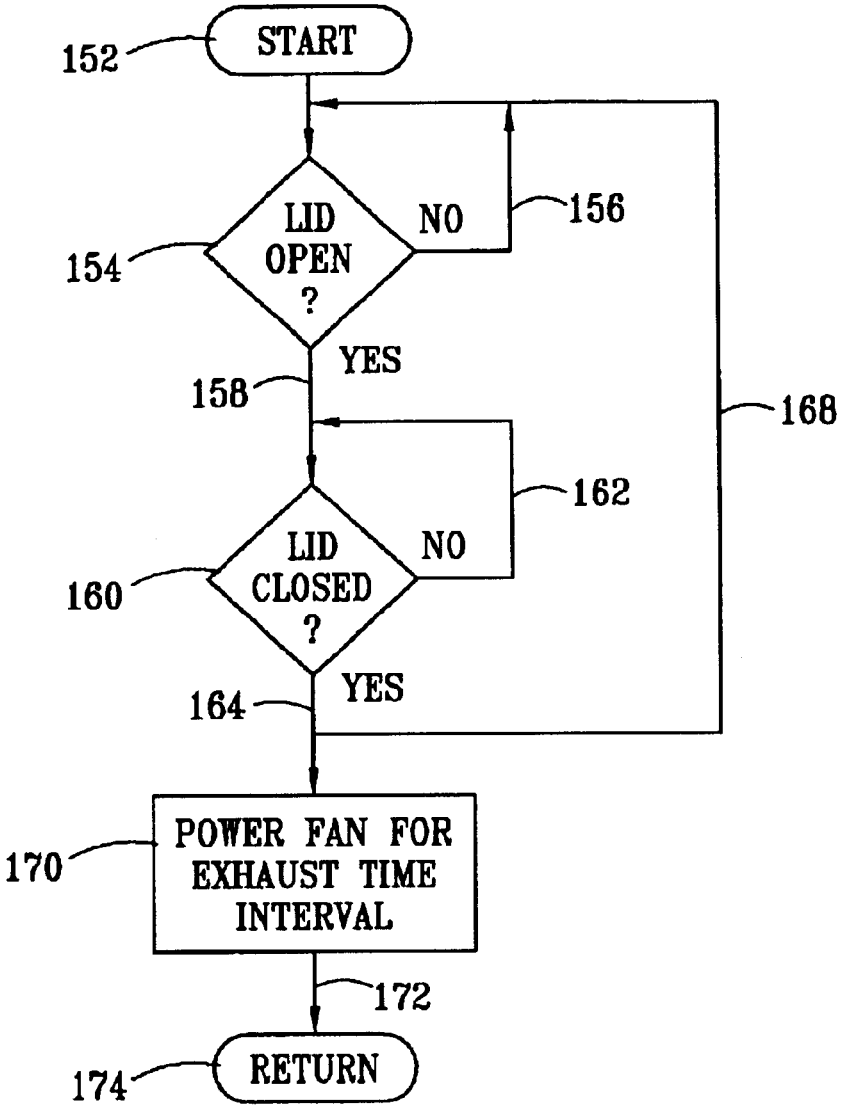
FIG. 7 is a flowchart depicting operation of the self-contained exhaust fan.

FIG. 7 is a flowchart depicting operation of the exhaust unit 26. The process starts at the start block 152. Then, in the decision block 154, a determination is made of whether the position sensor 144 has sensed the toilet lid 22 being moved to the open position. If the lid 22 has not been moved to the open position, the process moves along the flow path 156 and back again to the beginning of the decision block 154. Once the position sensor 144 detects that the lid 22 has been moved to the open position, the process moves along the flow path 158 to the decision block 160 to determine whether the position sensor 144 has detected the lid 22 being moved into a closed position. If the lid 22 is not in the closed position, the process will move along the flow path 162 back to the flow path 158, and then return to the decision block 160. Once the position sensor 144 detects that the lid 22 has been placed in the closed position, the process will proceed along the flow path 164 to the block 170, and the fan motor 74 will be powered for an exhaust time interval. Preferably, the exhaust time interval will last approximately two minutes, such that the air in the bowl will be evacuated and passed through the exhaust unit 26 to remove microbial and viral particulate matter which were swirled inside the bowl as a result of swirling of the water from the flush. The processes then proceeds along the flow path 172 to the return step 174, and then back to the start step 152 to detect when the lid 22 is lifted and then subsequently closed. The process also proceeds from the step of block 160 back to the step of block 154 to detect whether the lid 22 is opened after a flush, such as which may occur during a second use of the water closet 12 occurring soon after a detected flush, while the exhaust fan unit 26 is still operating. If so, the fan circuit time will reset and proceed again through the steps 154, 160 and 170.

The filter media 36 is preferably replaced monthly, or as the user determines is necessary by visually inspecting the filter media 36. The replaceable dust filter 82 may be cleaned when the filer media 36 is replaced. Tools are not required to remove and replace the cover 30 and the cap 80, nor to remove the filter cartridge 34, the battery pack 40, or the dust cover 82.

Figure 8:
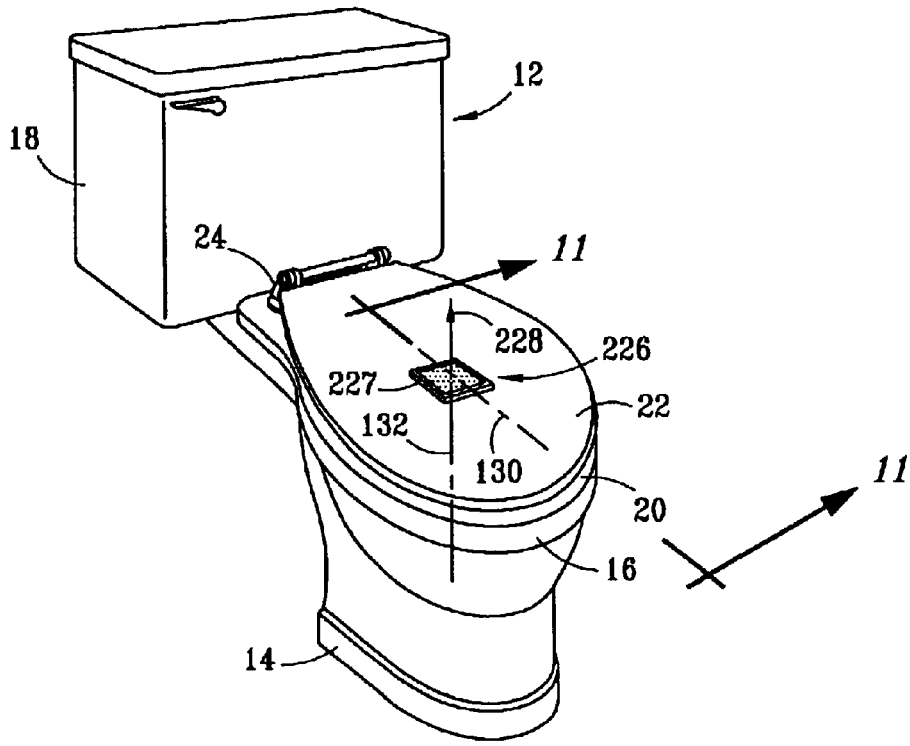
FIG. 8 is a perspective view of a water closet having a self-contained exhaust fan mounted to a lid of the water closet.

FIG. 8 is a perspective view of the water closet 12, with the seat 20 and the lid 22 shown in the horizontally disposed position, covering the toilet bowl 16. An alternative, battery powered, self-contained exhaust fan unit 226 is mounted to a central region 227 of the lid 22. The exhaust fan unit 226 performs the same function as that of the exhaust fan 26, described above, but is of a rectangular configuration rather than the round configuration of the exhaust fan unit 26. The exhaust fan 226 will remove air from the toilet bowl 16, filter the air and exhaust the air upwards in the direction 228 and above an upperside of the lid 22, perpendicular to a horizontal plane.

Figure 9:
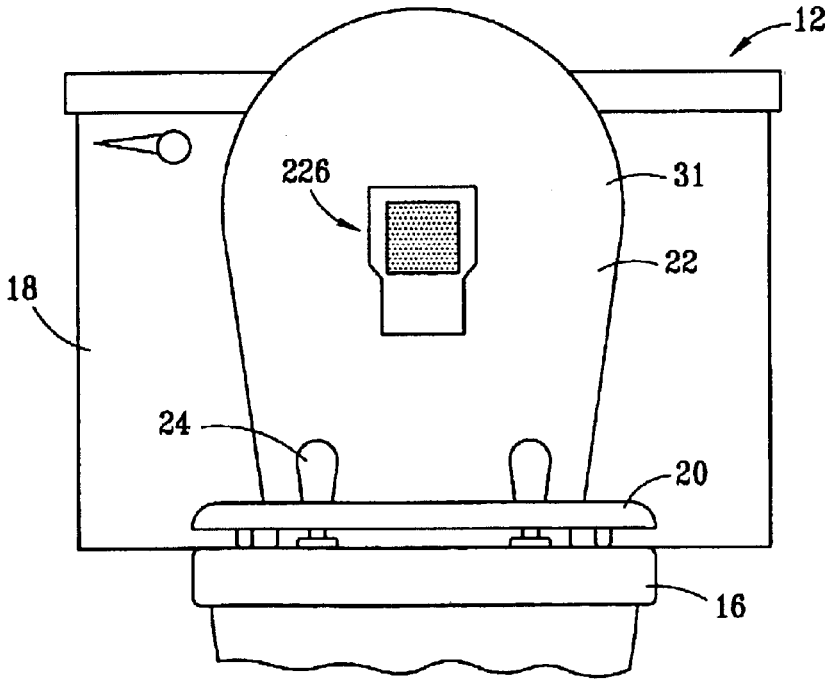
FIG. 9 is a side elevation view showing the lid in an upward position.

FIG. 9 is a side elevation view of the water closet 12, showing the lid 22 in a vertical position, such that the toilet bowl 16 is open. When the lid 22 is in a vertical position, the lid 22 will extend in a vertical direction. A lower end of the exhaust unit 226 is shown mounted to an underside of the lid 22.

Figure 10:
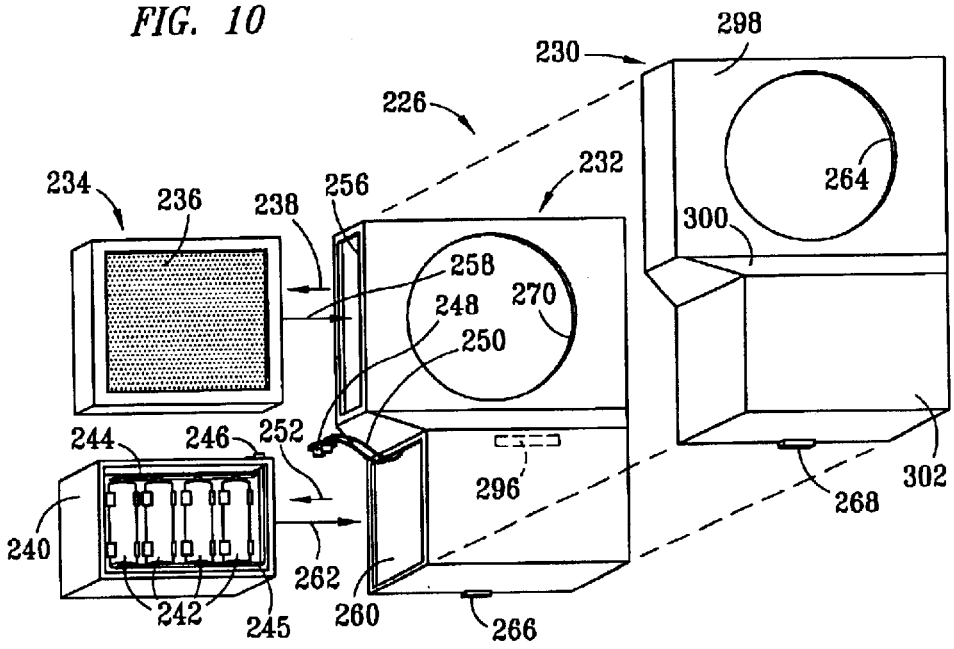
FIG. 10 is an exploded, perspective view of the self-contained exhaust fan.

FIG. 10 is an exploded, perspective view of the exhaust unit 226. The main components of the exhaust unit 226 are a cover 230, a base 232, a filter cartridge 234, and a battery pack, or power pack 240. The cover 230 is removably secured to the base 232, covering the lower side of the base unit 232. The lower side of the base 232 is that portion which extends beneath the lid 22 when the lid 22 is disposed in a downward position. The filter cartridge 234 includes a filter media 236, which preferably filters particles which range in size from two to ten microns. Preferably, the filter media 236 has a Merv rating of eleven at an eighty percent minimum composite efficiency, based on ASHRAE Standard 52.2. The power pack preferably includes a total eight 1.5 volt double-A batteries 242 which are connected in series to provide a power pack voltage of 12.0 volts DC for powering the exhaust unit 226. The power pack has contact bars 244 and contact bars 245 which electrically connect the batteries 242 of the power pack 240 in series. A connector 246 is provided on the power pack 240 for electrically connecting to the connector 248, which is connected by lead wires 250 to the base 232. The base 232 has a filter cartridge window 256 and a battery pack window 260. The filter cartridge 234 is removed from the base 232 for replacing the filter media 236 by moving the filter cartridge 234 in the direction 238 and through the window 256. The filter cartridge 234 is mounted within the base 232 by moving the cartridge 234 in the direction 258 through the window 256 and into the base 232. Similarly, the power pack 240 is removed from within the base 232 by moving in the direction 252 through the window 260. The power pack 240 is installed into the base 232 by being moved in the direction 262 and through the window 260. The connector 248 will preferably be removed from the connector 246 of the power pack 240 when the power pack 240 is disposed exteriorly of the base 232.

The base 232 has latch tabs 266 which are provided by protuberances molded into opposite ends of base 232. Preferably, the latch tabs 266 are on upper and lower ends of the base 232, as defined when the lid 22 is disposed in an upward, or vertical position, as shown in FIG. 9. Clasp tabs 268 are molded into opposite ends of the cover 230 for securing to the latch tabs 266, to releasibly secure the cover 230 to the base 232. The cover 230 has an airflow window 264 and the base 232 has an inlet window 270 which register to provide an intake of the exhaust unit 26 when the cover 230 is mounted to the base 232. Preferably, the airflow inlet 264 of the cover 230 has a circular aperture, but in other embodiments can be other shapes, including rectangular, square, octagonal, elliptical, and such other shapes. The window 270 in the base 232 is also of circular shape, but preferably of a size which is larger than the window 264 so that a pattern of discoloration will occur when the filter media 236 is soiled to alert the user that the media 236 is soiled and requires replacement when the cover 230 is removed and the filter media 236 in the cartridge 234 is inspected. Preferably, as least part of the window 264 will overlap the window 270, such that the overlap of window 64 is disposed within an adjacent portion of the window 270. This provides the fan inlet window 270 in the base 232 being of a different size than the window 264 of the cover 230, such that the window 270 exposes a different portion of the filter media 236 than the window 264, the filter media 236 may be inspected for discoloration from soiling without removing the filter cartridge 234 from the base 232. Similarly, in other embodiments, the windows 264 and 270 may be of different shapes for exposing different portions of the filter media for soiling when the cover plate 230 is removed from the base 232.

Figure 11:
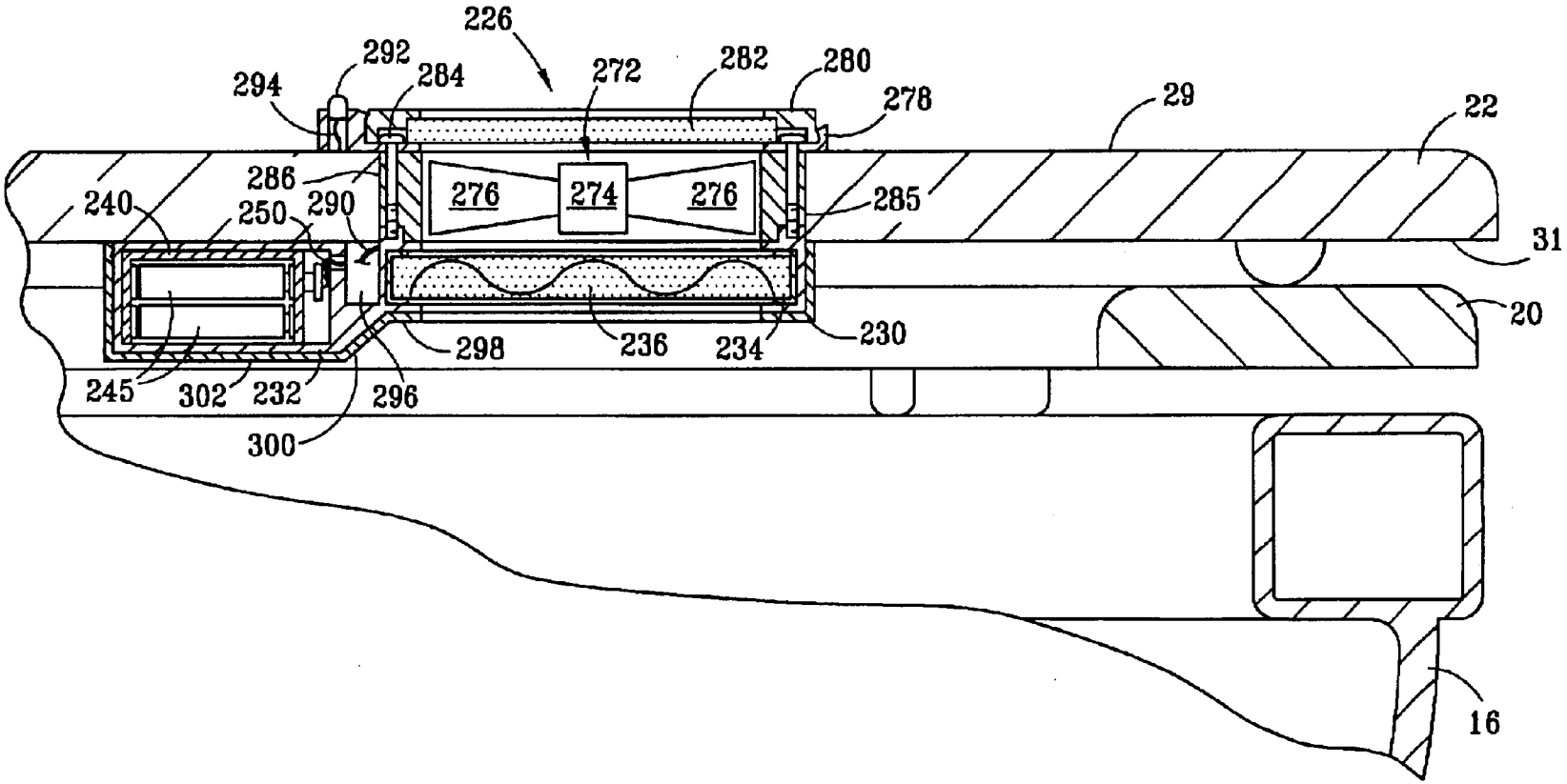
FIG. 11 is a sectional view of the water closet and self-contained exhaust fan, taken along section line 11—11 of FIG. 8.

FIG. 11 is a sectional view of the lid 22 and the exhaust unit 226, taken along section line 11—11 of FIG. 8. The exhaust unit 226 has a fan unit 272 which includes a fan motor 274 and fan blades 276. Preferably, the fan motor 274 is a 12.0 volt DC powered electric motor. A mounting bracket 278 is provided for mounting to an upperside of the lid 22, with the upperside of the lid 22 being defined when the lid 22 is in a lowered, or downward, horizontal position, shown in FIG. 8. A cap 280 is provided for securing to the mounting bracket 278. A dust cover 282, which is preferably formed of foam, is mounted between the lid cap 280 and the mounting bracket 78. The cap 2, 80 and the dust cover 282 are removable from the mounting bracket 278 so that the dust cover 282 may be cleaned or replaced. Mounting bolts 284 extend through the mounting bracket 278, through a housing 285 of the fan unit 272 and are threadingly secured to the base 232. The filter cartridge 234 is secured within the base 232, with the filter media 236 disposed adjacent to the inlet of the fan 272. The dust cover 282 is disposed adjacent to the outlet of the fan unit 272. The power pack 240 is disposed within the base 232, with two rows of the batteries 245 shown. The batteries 245 are connected to a control unit 296 by conductors 250 (shown in FIG. 10). Conductors 290 connect from the control unit 296 to the fan motor 274 to power the fan unit 272. A signal light 292 is provided by an LED which is mounted in a cavity 294 of the mounting bracket 278. The signal light 292 is connected to the control unit 296 by conductors 294, preferably by routing the conductors through a surface groove formed in the peripheral edge of the housing 285 for the fan unit 272.

Figure 12:
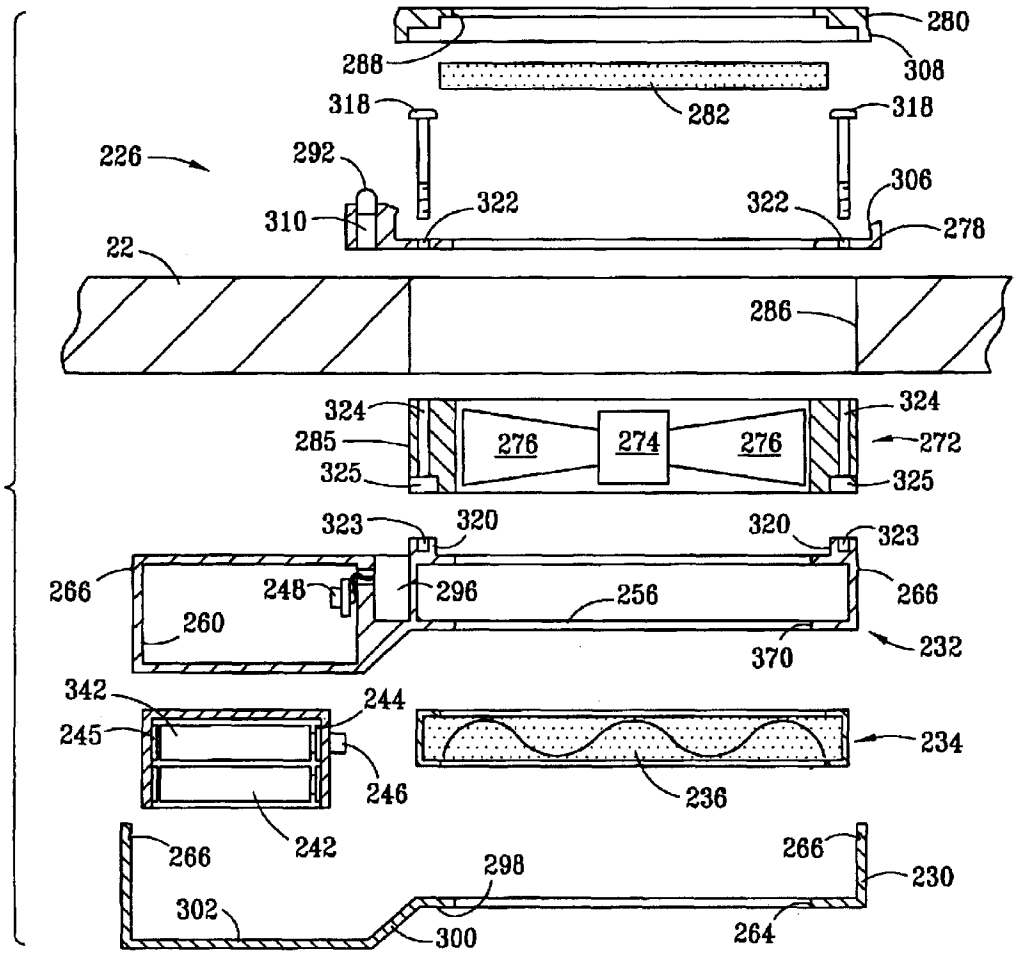
FIG. 12 is a exploded, sectional view of the self-contained exhaust fan.

FIG. 12 is an exploded, sectional view of the various components of the exhaust unit 26. A window 288 is located in a central region of the cap 280. The cap 280 has a protuberance 308 which defines an exteriorly extending lip that extends from an exterior periphery at the lower end of the cap 280. The mounting bracket 278 has an inwardly extending protuberance 3.06 which defines an interiorly extending lip that the extends from an interior profile of the mounting bracket 278 and an adjacent, interiorly disposed recess for receiving the protuberance 308 of cap 280. The protuberances 306 and 308 interlock to releasibly secure the cap 308 to the mounting bracket 278 in a snap-in type engagement. A hole 286 is formed through the toilet lid 22, and the fan unit 272 is mounted within the hole 286. Preferably, the hole 286 is a round, circular hole, but in other embodiments it may be of another shape, such as square, octagonal, and the like. When the hole 286 is of a different shape than circular, the exterior periphery of the housing 285 of the fan unit 272 may have a periphery of a shape which matches a shape defined by the profile of the hole 286 to lock the fan unit 272 in a fixed angular position relative to the lid 22 of the water closet 12.

Mounting holes 322 are provided in the mounting bracket 278. The fan housing 285 has mounting holes 324. The underside of the fan housing 285 has openings 325 aligned adjacent to the mounting holes 324 for receipt of the bosses 320 formed as part of the upperside of the base 232. The bosses 320 have threaded apertures 323 for threadingly receiving the shanks of the mounting bolts 318. The mounting bolts 318 extend through the mounting holes 322 and the mounting holes 324, and then pass into the threaded apertures 323 of the bosses 320 to secure the mounting bracket 278 and the base 232 on opposite sides of the toilet seat lid 22, with the housing 285 of the fan unit 272 disposed in the mounting hole 286, sandwiched between the base 232 and the mounting bracket 278. The lower end of the cover plate 230 has a lower face 298, which is disposed adjacent to the aperture providing the window 264. An opposite end of the base plate 232 has a planar face 302, which extends parallel to the planar face 298, but further downward to accommodate the double rows of batteries 242 of the power pack 240, which is preferably wider than, or thicker than, the filter cartridge 234. An angled surface 300 extends preferably at a forty-five degree angle to the surfaces 298 and 302 to interconnect the two surfaces. A latch catch 266 is provided on the base 232 for being engaged with the latch clasp 268 of the cover 230, to removably secure the cover 230 to the base 232. A connector 246 of the power pack 240 is shown extended for securing to a connector 248, which electrically connects to the control unit circuitry 296.

The alternative exhaust unit 226 may be wired according to the circuit diagram shown above in FIG. 6 for the exhaust fan unit 26, except that the exhaust unit 226 is electrically powered by the power pack 240 rather than standard household power applied as a power supply 46 for the exhaust unit 26. Preferably, the power pack 240 will provides electric power across the contacts of connectors 46 and 48, preferably 12 volts DC. Power is applied to the control unit 96, as discussed above, and is applied according to movement of the position sensor 144 with the lid 22 such that the fan 272 will run for a preselected time interval after the lid 22 is lowered to a downward position.

The signal light 292 is also preferably provided by an LED, and power will be applied to the signal light 292 only when power is applied to the exhaust fan motor 274. However, a different signal will be applied to the signal light 292 depending upon the output voltage of the power pack 240, to provide an indication of the strength of the batteries 242 in the power pack 240. Preferably, the signal light 292 will either blink or stay on continuously, depending upon the level of the voltage in the power pack 240, as sensed by the control unit 296. Preferably, the power output voltage of the LED is applied to a capacitor-type flasher circuit which flashes at a significantly different frequency when the voltage output of the power pack 240 falls beneath a selected voltage level, than a frequency at which it flashes when the voltage output of the power pack is above the selected voltage level. At one such level, the frequency may be such that the signal light 292 remains on continuously when power is applied to the fan motor 274, rather than flashing. In alternate embodiments, the output voltage of the power pack 240 maybe applied directly to the signal light 292, with a lower voltage resulting in a lower light output being emitted from the signal light 292. The lower light output provides an indication at to when to replace or to recharge the batteries 242 in the power pack 240.

Thus, the exhaust fan unit 226 is mounted in a hole 286 which extends through a central region 227 of a lid 22 of a water closet 12 for exhausting air from within a bowl 16 of the water closet 12 when the lid 22 is horizontally disposed, in a closed position: A housing 232 is mounted to the lid 22 and has a first window 256 for receiving a filter cartridge 234 and a second window 260 for receiving a power pack 240. The control unit 296 preferably includes the position sensor 144 and control logic 142 of the control unit 96. The position sensor 144 detects when the lid 22 is moved from a vertically disposed, open position to the closed position. The control logic 142 applies electric power to operate the fan unit 272 according to a predetermined sequence when the lid 22 is disposed in the closed position. The predetermined sequence may include a time delay prior to the fan start after the flush, to allow the swirl of air within the bowl 16 to subside, such as a time delay of ten to thirty seconds.

Figure 13:
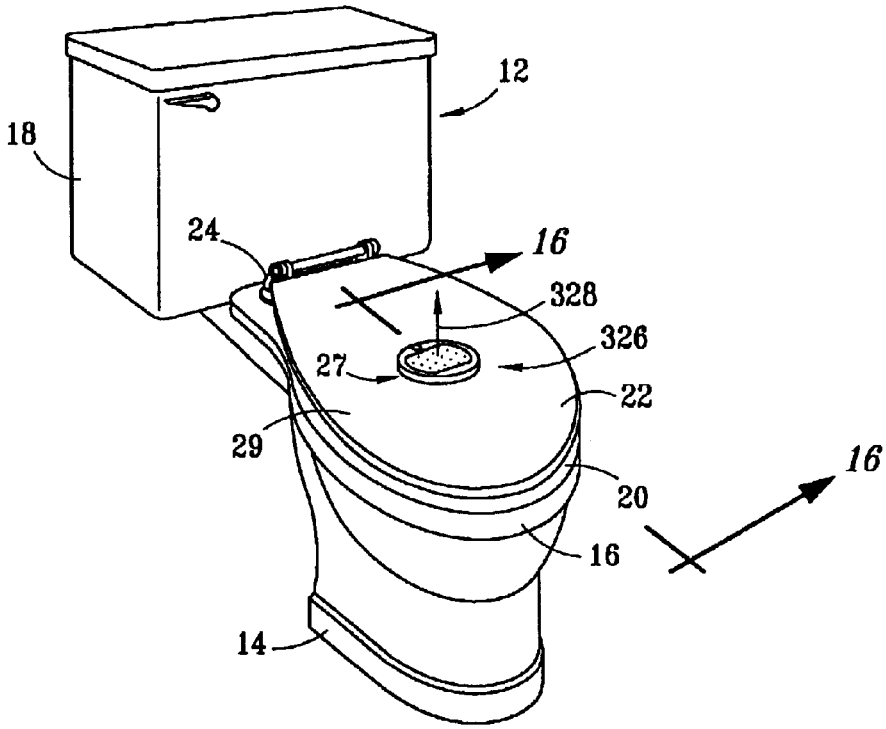
FIG. 13 is a perspective view of a water closet having a self-contained exhaust fan mounted to a lid of the water closet.

FIG. 13 is a perspective view of the water closet 12 having a second alternative, self-contained contained exhaust fan unit 326 mounted to the central region 27 of the lid 22. The exhaust fan unit 326 will remove air from the toilet bowl 16, filter the air and exhaust the air upwards in the direction 328 and above an upperside 29 of the lid 22, perpendicular to a horizontal plane.

Figure 14:
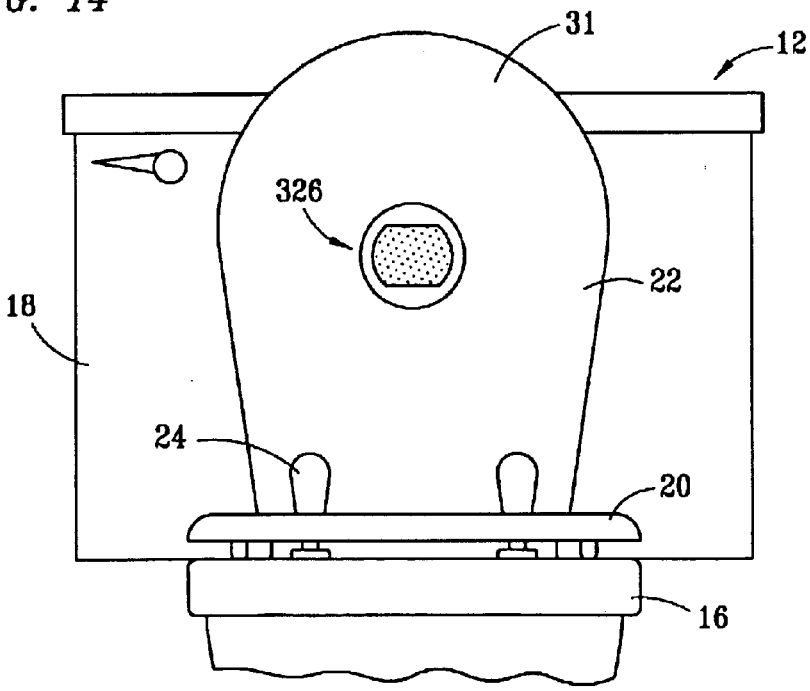
FIG. 14 is a side elevation view showing the lid in an upward position.

FIG. 14 is a side elevation view of the water closet 12, showing the lid 22 in a vertical position, such that the toilet bowl 16 is open. A lower end of the exhaust unit 326 is shown mounted to an underside 31 of the lid 22. The upperside 29 and the underside 31 of the lid 22 together define a plane for the lid 22, which extends parallel to the sides 29 and 31. As defined herein, the lid 22 is disposed in the upwards, or open, position when the plane of the lid 22 is vertical, as shown in FIG. 2. The lid 22 is disposed in the downward, or closed, position when the plane of the lid is horizontal.

Figure 15:
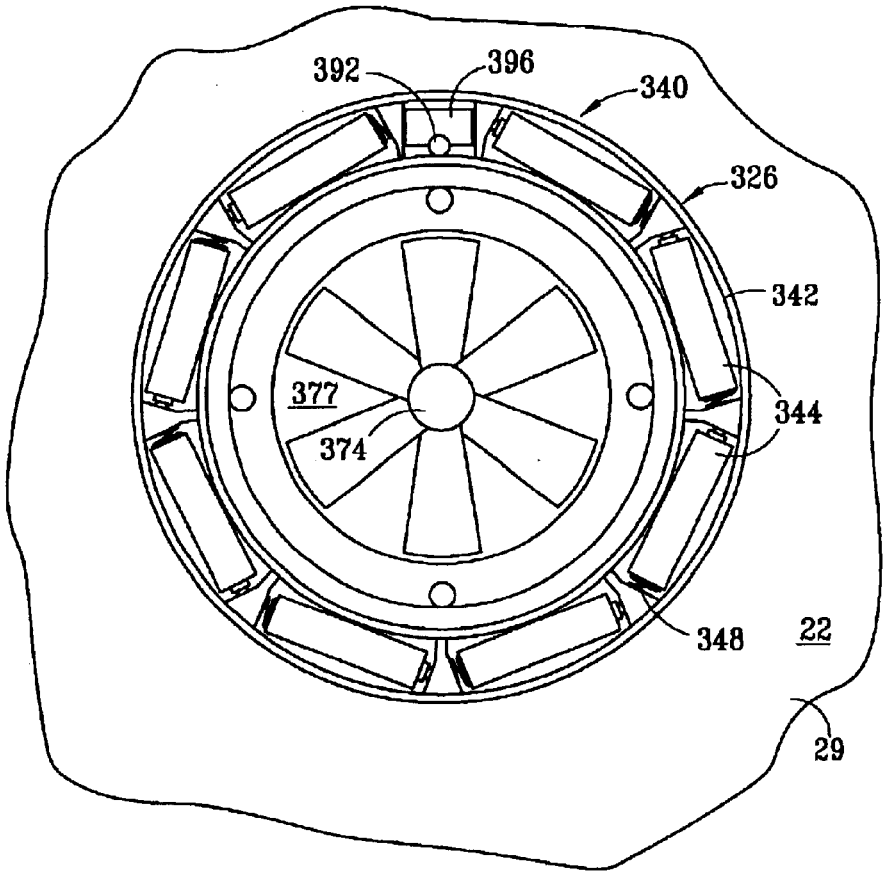
FIG. 15 is a top view of a the self-contained exhaust fan, showing a battery compartment.
Figure 16:
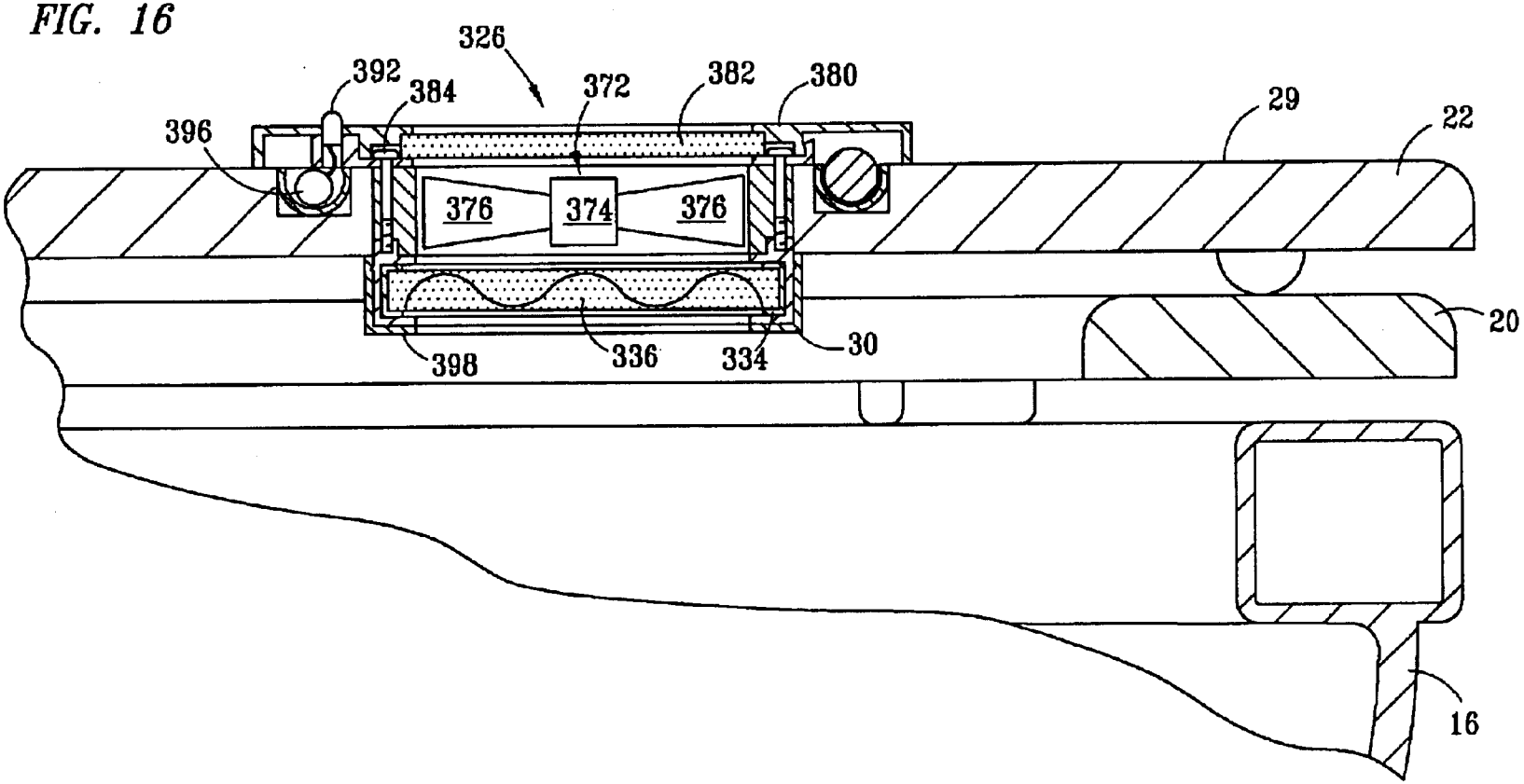
FIG. 16 is a sectional view of the water closet and self-contained exhaust fan, taken along section line 16—16 of FIG. 13.

FIG. 15 is a top view of a the self-contained exhaust fan 326, showing a battery compartment 340. A cover 380 has been removed from the upperside of the exhaust fan 326. The battery compartment 340 is disposed within the self contained exhaust fan 326, and has a battery tray 342. The battery tray 342 is partially recessed in the upperside 29 of the lid 22. Eight batteries 344 are disposed within the battery tray 342, and are electrically connected together in series. A control unit 396, which includes a tilt switch 442 is connected between the ends of the series of eight batteries 44 and the control logic 142 of the control unit 96. Wires 346 connect to a fan motor 374 to power a fan 372. A signal light 392 is mounted to the top of the control unit 396, and is preferably provided by an L.E.D. Spring contacts 348 connect between adjacent batteries 344 and the control unit 396. The output of the eight batteries 344 connected in series is preferably twelve volts D.C.

Figure 17:
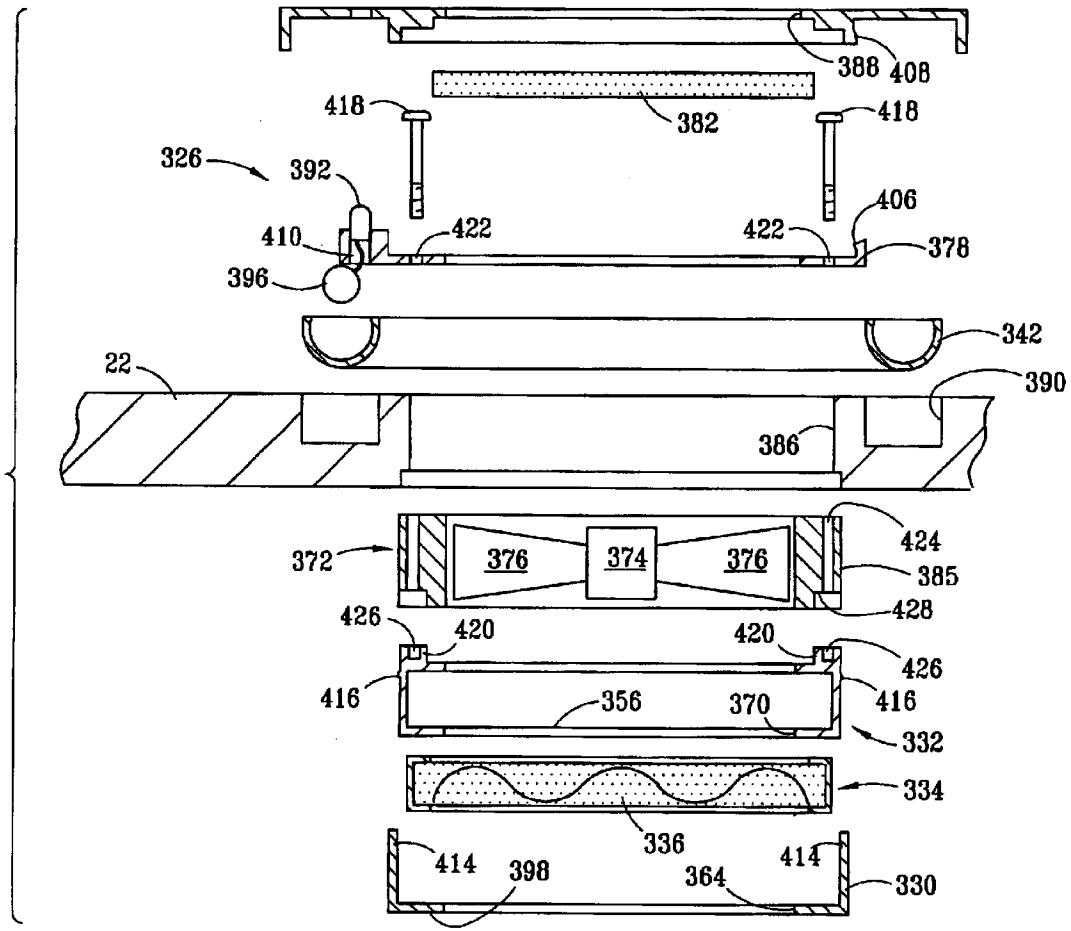
FIG. 17 is an exploded, sectional view of the self-contained exhaust fan.

FIG. 17 is a sectional view of the lid 22 and the exhaust unit 326, taken along section line 17—17 of FIG. 13. The main components of the exhaust unit 326 are the cover 330, a base 332, a filter cartridge 334. The cover 330 is removably secured to the base 332, covering the lower side of the base unit 332. The lower side of the base 332 is that portion which extends beneath the lid 22 when the lid 22 is disposed in a downward position. The filter cartridge 334 includes a filter media 336, which preferably filters particles which range in size from two to ten microns. Preferably, the filter media 336 has a Merv rating of eleven at an eighty percent minimum composite efficiency, based on ASHRAE Standard 52.2. The base 332 has a filter cartridge window similar to the window 56 of FIG. 3, and through which the filter cartridge 334 is installed and removed from the base 332 for replacing the filter media 336.

The base 332 has latch tabs 416 which are provided by protuberances molded into opposite ends of base 332. Preferably, the latch tabs 416 are on upper and lower ends of the base 332, as defined when the lid 22 is disposed in an upward, or vertical position, as shown in FIG. 2. Clasp tabs 414 are preferably provide by notches which are molded into opposite ends of the cover 330 for securing to the latch tabs 416, to releasibly secure the cover 330 to the base 332. The cover 330 has an airflow window 364 and the base 332 has an inlet window 370 which register to provide an intake of the exhaust unit 326 when the cover 330 is mounted to the base 332. Preferably, the airflow inlet 364 of the cover 330 has an aperture which is of a size and shape which is slightly smaller than the size and shape of the filter media 336 of the filter cartridge 334, such that a pattern of discoloration will occur when the filter media 336 is soiled to alert the user that the media 336 is soiled and requires replacement when the filter media 336 in the cartridge 334 is inspected. Preferably, as least part of the window 64 will overlap the window 370, such that the overlap of window 364 is disposed within an adjacent portion of the window 370. This provides the fan inlet window 370 in the base 332 being of a different size than the window 364 of the cover 330, such that the window 370 exposes a different portion of the filter media 336 than the window 364, the filter media 336 may be inspected for discoloration from soiling after removal of the cover 330 and without removal of the filter cartridge 334 from the base 332. Similarly, in other embodiments, the windows 364 and 370 may be of different shapes for exposing different portions of the filter media for soiling when the cover 330 is removed from the base 332.

The exhaust unit 326 has a fan unit 372 which includes a fan motor 374 and fan blades 376. Preferably, the fan motor 374 is a 12.0 volt DC powered electric motor. A mounting bracket 378 is provided for mounting to an upperside 29 of the lid 22. A cap 380 is provided for securing to the mounting bracket 378. A dust cover 382, which is preferably formed of foam, is mounted between the lid cap 380 and the mounting bracket 378. The cap 80 and the dust cover 82 are removable from the mounting bracket 378 so that the dust cover 382 may be cleaned or replaced. Mounting bolts 384 extend through the mounting bracket 378, through a housing 385 of the fan unit 372 and are threadingly secured to the base 332. The filter cartridge 334 is secured within the base 332, with the filter media 336 disposed adjacent to the inlet of the fan 372. The dust cover 382 is disposed adjacent to the outlet of the fan unit 372.

FIG. 17 is an exploded, sectional view of the various components of the exhaust unit 326. A window 388 is located in a central region of the cap 380. The cap 380 has a protuberance 408 which defines an exteriorly extending lip that extends from an exterior periphery at the lower end of the cap 380. The mounting bracket 378 has an inwardly extending protuberance 406 which defines an interiorly extending lip that the extends from an interior profile of the mounting bracket 378 and an adjacent, interiorly disposed recess for receiving the protuberance 408 of cap 380. The protuberances 406 and 408 interlock to releasibly secure the cap 408 to the mounting bracket 378 in a snap-in type engagement. A hole 386 is formed through the toilet lid 22, and the fan unit 372 is mounted within the hole 386. Preferably, the hole 386 is a round, circular hole, but in other embodiments it may be of another shape, such as square, octagonal, and the like. When the hole 386 is of a different shape than circular, the exterior periphery of the housing 385 of the fan unit 72 may have a periphery of a shape which matches a shape defined by the profile of the hole 836 to lock the fan unit 372 in a fixed angular position relative to the lid 22 of the water closet 12. A hole 390 is provided in the upper portion of hole 386, providing a profile for receiving the battery tray 342.

Mounting holes 422 are provided in the mounting bracket 378. The fan housing 385 has mounting holes 424. The underside of the fan housing 385 has openings 428 aligned adjacent to the mounting holes 424 for receipt of the bosses 420 formed as part of the upperside of the base 332. The bosses 420 have threaded apertures 426 for threadingly receiving the shanks of the mounting bolts 418. The mounting bolts 418 extend through the mounting holes 422 and the mounting holes 424, and then pass into the threaded apertures 426 of the bosses 420 to secure the mounting bracket 378 and the base 332 on opposite sides of the toilet seat lid 22, with the housing 385 of the fan unit 372 disposed in the mounting hole 386, sandwiched between the base 332 and the mounting bracket 378. The lower end of the cover 330 has a lower face 398, which is disposed adjacent to the aperture providing the window 364. The latch catch 416 is provided on the base 332 for being engaged with the latch clasp 114 of the cover 330, to removably secure the cover 330 to the base 332.

The present invention provides several advantages over prior art exhaust fans for water closets. Prior exhaust fans for water closets typically operated only when the lid was in the open position, and only for the purpose of reducing odors and not to capture microbial and viral agents which cause diseases and infections. With the present invention, the exhaust fan only operates when the toilet lid is closed to pass air from within the toilet bowl through a filter media.

Although the preferred embodiment has been described in detail, it should be understood that various changes, substitutions and alterations can be made therein without departing from the spirit and scope of the invention as defined by the appended claims.

What is claimed is:

1. An exhaust fan for a water closet, the water closet having a bowl, a seat and a lid, with the lid pivotally mounted to the bowl, the exhaust fan comprising:

the lid having hinges for pivotally connecting to the bowl, a top surface and a bottom surface which faces the interior of the water bowl, the lid further having a hole formed therein, said hole extending from the top surface through the bottom surface at a central region of the lid, transverse to a plane defined by the lid, said plane extending horizontally when said lid is disposed in a closed position;

a filter cartridge having filter media;

a housing disposed within said hole in the lid, said housing having a first window for removably receiving said filter cartridge, such that said filter media is disposed for receiving the air being exhausted from within the bowl by a fan unit, said fan unit disposed in fixed relation to said housing for exhausting air from within the bowl, through said hole and exteriorly of the bowl of the water closet, transverse to the plane of the lid;

said housing having apertures defining an airflow inlet and an airflow outlet, wherein said airflow inlet and said airflow outlet are axially and centrally aligned with said hole of the lid, such that said fan unit exhausts the air from within the bowl of the water closet when the lid is disposed in the closed position, in which the plane defined by the lid is horizontally disposed; and a control circuit having a position sensor and control logic, said position sensor detecting when the lid is moved from an open, vertical position to the closed position, and said control logic applying electric power to operate said fan unit according to a predetermined sequence when said lid is disposed in the closed position.

2. The exhaust fan according to claim 1, wherein said housing further comprises a second window for removably receiving a power pack for powering said fan unit.

3. The exhaust fan according to claim 2, wherein said housing comprises a base mounted to an underside of the lid, said base having said first window for removably receiving said filter cartridge and said second window for removably receiving a battery pack; and said housing further having a cover plate mounted to said base, and enclosing said first and second windows.

4. The exhaust fan according to claim 3, further comprising a signal light connected to said control circuit, said signal light indicating a remaining electric charge of said power pack.

5. The exhaust fan according to claim 4, wherein said signal light is powered on only when said fan unit is operating.

6. The exhaust fan according to claim 1, further comprising a signal light connected to said control circuit, said signal light indicating when said fan unit is operating.

7. The exhaust fan according to claim 1, wherein said predetermined sequence of said control logic of said control circuit comprises applying power to said fan unit for a predetermined exhaust time interval.

8. The exhaust fan according to claim 1, wherein said housing further comprises a cap mounted to an upperside of said lid, and said fan unit further including a dust cover which is retained within said housing by said cap.

9. An exhaust fan for a water closet, the water closet having a bowl, a seat and a lid, with the lid pivotally mounted to the bowl, the exhaust fan comprising:

the lid having hinges for pivotally connecting to the bowl, a top surface and a bottom surface which faces the interior of the water bowl, the lid further having a hole formed therein, said hole extending from the top surface through the bottom surface at a central region of the lid, transverse to a plane defined by the lid, said plane extending horizontally when said lid is disposed in a closed position;

a filter cartridge having filter media;

a housing disposed within said hole in the lid, said housing having a first window for removably receiving said filter cartridge, such that said filter media is disposed for receiving the air being exhausted from within the bowl by a fan unit, said fan unit disposed in fixed relation to said housing for exhausting air from within the bowl, through said hole and exteriorly of the bowl of the water closet, transverse to the plane of the lid, said housing further having a second window for removably receiving a power pack for powering said fan unit;

said housing having apertures defining an airflow inlet and an airflow outlet, wherein said airflow inlet and said airflow outlet are axially and centrally aligned with said hole of the lid, such that said fan unit exhausts the air from within the bowl of the water closet when the lid is disposed in the closed position, in which the plane defined by the lid is horizontally disposed;

a control circuit having a position sensor and control logic, said position sensor detecting when the lid is moved from an open, vertical position to the closed position, and said control logic applying electric power to operate said fan unit according to a predetermined sequence when said lid is disposed in the closed position; and wherein said predetermined sequence of said control logic of said control circuit comprises delaying applying power to said fan unit for a predetermined fan start time delay after the lid of the water closet is closed, and then powering said fan unit for a predetermined exhaust time interval.

10. The exhaust fan according to claim 9, wherein said housing comprises a base mounted to an underside of the lid, said base having said first window for removably receiving a filter cartridge; and said housing further having a cover plate mounted to the base and enclosing said first window.

11. The exhaust fan according to claim 9, further comprising a signal light connected to said control circuit, said signal light indicating an amount of electric charge of said power pack.

12. The exhaust fan according to claim 11, wherein said signal light is powered on only when said fan unit is operating.

13. The exhaust fan according to claim 9, further comprising a signal light connected to said control circuit, said signal light indicating when said fan unit is operating.

14. The exhaust fan according to claim 9, wherein said housing further comprises a cap mounted to an upperside of said lid, and said fan unit further including a dust cover which is retained within said housing by said cap.

15. The exhaust fan according to claim 9, further comprising a battery pack which includes a plurality of batteries which are connected in series to provide an output voltage of twelve volts DC to power said fan unit.

16. An exhaust fan for a water closet, the water closet having a bowl, a seat and a lid, with the lid pivotally mounted to the bowl, the exhaust fan comprising:

the lid having hinges for pivotally connecting to the bowl, a top surface and a bottom surface which faces the interior of the water bowl, the lid further having a hole formed therein, said hole extending from the top surface through the bottom surface at a central region of the lid, transverse to a plane defined by the lid, said plane extending horizontally when said lid is disposed in a closed position;

a filter cartridge having filter media;

a power pack for powering said fan unit;

a base disposed within said hole in the lid, said base unit having said first window for removably receiving a filter cartridge, such that said filter media is disposed for receiving the air being exhausted from within the bowl by a fan unit, said fan unit disposed in fixed relation to said housing for exhausting air from within the bowl, through said hole and exteriorly of the bowl of the water closet, transverse to the plane of the lid, said housing further having a second window for removably receiving a power pack for powering said fan unit;

a cover plate mounted to the base, and enclosing said first and second windows;

a cap mounted to an upperside of said lid;

said base, said cover plate and said cap together having apertures defining an airflow inlet and an airflow outlet, wherein said airflow inlet and said airflow outlet are axially and centrally aligned with said hole of the lid, such that said fan unit exhausts the air from within the bowl of the water closet when the lid is disposed in the closed position, in which the plane defined by the lid is horizontally disposed;

a control circuit having a position sensor and control logic, said position sensor detecting when the lid is moved from an open, vertical position to the closed position, and said control logic applying electric power to operate said fan unit according to a predetermined sequence when said lid is disposed in the closed position; and wherein said predetermined sequence of said control logic of said control circuit comprises delaying applying power to said fan unit for a predetermined fan start time delay after the lid of the water closet is closed, and then powering said fan unit for a predetermined exhaust time interval.

17. The exhaust fan according to claim 16, wherein said signal light is powered on only when said fan unit is operating.

18. The exhaust fan according to claim 17, further comprising a dust cover disposed on said lid, between said fan unit and said cap.

19. The exhaust fan according to claim 16, further comprising a battery pack which includes a plurality of batteries which are connected in series to provide an output voltage of twelve volts DC.

20. The exhaust fan according to claim 19, further comprising a signal light connected to said control circuit, said signal light indicating a remaining electric charge status of said battery pack.

* * * * *